US006109888A

United States Patent [19]

Marshall

[11] Patent Number: 6,109,888

[45] Date of Patent: Aug. 29, 2000

[54] ELECTROMAGNETICALLY DRIVEN PERISTALTIC PUMP

[75] Inventor: Douglas W. Marshall, Blackfoot, Id.

[73] Assignee: Bechtel BWXT Idaho, LLC, Idaho Falls, Id.

[21] Appl. No.: 09/150,506

[22] Filed: Sep. 9, 1998

[51] Int. Cl.[7] ..... F04B 17/00

[52] U.S. Cl. ..... 417/413.1; 417/327

[58] Field of Search ..... 417/413.1, 327, 417/367, 372

[56] References Cited

U.S. PATENT DOCUMENTS

| | | | |
|---|---|---|---|
| 4,424,099 | 1/1984 | van Os | 417/394 |
| 4,498,850 | 2/1985 | Perlov et al. | 417/322 |
| 6,007,309 | 12/1999 | Hartley | 417/322 |

*Primary Examiner*—Henry C. Yuen
*Assistant Examiner*—Arnold Castro
*Attorney, Agent, or Firm*—Klass Law O'Meara & Malkin

[57] ABSTRACT

An electromagnetic peristaltic pump apparatus may comprise a main body section having an inlet end and an outlet end and a flexible membrane which divides the main body section into a first cavity and a second cavity. The first cavity is in fluid communication with the inlet and outlet ends of the main body section. The second cavity is not in fluid communication with the first cavity and contains an electrically conductive fluid. The second cavity includes a plurality of electrodes which are positioned within the second cavity generally adjacent the flexible membrane. A magnetic field generator produces a magnetic field having a plurality of flux lines at least some of which are contained within the second cavity of the main body section and which are oriented generally parallel to a flow direction in which a material flows between the inlet and outlet ends of the main body section. A control system selectively places a voltage potential across selected ones of the plurality of electrodes to deflect the flexible membrane in a wave-like manner to move material contained in the first cavity between the inlet and outlet ends of the main body section.

22 Claims, 5 Drawing Sheets

ELECTROMAGNETICALLY DRIVEN PERISTALTIC PUMP

CONTRACTUAL ORIGIN OF THE INVENTION

The United States has rights in this invention pursuant to Contract No. DE-AC07-94ID13223 between the U.S. Department of Energy and Lockheed Martin Idaho Technologies Company.

FIELD OF THE INVENTION

This invention relates to pumping apparatus in general and more specifically to pumping apparatus for pumping shear-sensitive materials.

BACKGROUND OF THE INVENTION

Many different types of pumps have been developed over the years for pumping a wide variety of materials. While it has proven relatively easy to develop pumps for use with a wide range of liquid materials having wide viscosity ranges, it has proven more difficult to develop pumps for use with more "exotic" materials. Such exotic materials may include, without limitation, inhomogeneous sludges, cement slurries, paints, paint pigments, or pastes, including toothpastes, peanut butter, mashed potatoes, etc. Non-Newtonian fluids, e.g., fluids in which the shearing stress is not proportional to the rate of shearing deformation, have also proven difficult to pump.

While pumps have been developed that are capable of pumping some types of exotic materials, they are not without their disadvantages. For example, many such pumps utilize rotating members, e.g., impellers, gears, screws, or vanes, which can subject the material being pumped to relatively high shear stresses. Such high shear stresses may break down or otherwise damage certain materials, thus making such pumps unsuitable for use with "shear sensitive" materials. The rotating members of such pumps must also be provided with bearings and seals, which may eventually leak and, in any event, usually require periodic maintenance, particularly of the material being pumped is highly corrosive. The flow rates and discharge pressures of such rotating pumps usually cannot be separately controlled which can pose difficulties in certain applications. Another problem with pumps having rotating members is that they are not well-suited for pumping slurries having relatively large solid particulate matter contained therein.

Diaphragm pumps are another type of pump which may be used to pump certain types of exotic materials. Diaphragm pumps are usually better suited for pumping slurries since they do not require rotating members to move the material. Another advantage of diaphragm pumps is that they tend not to subject the material to excessive shearing stresses, thereby allowing them to be used with certain types of shear sensitive materials. Most diaphragm pumps generally require one or more check valves to ensure that the material being pumped flows in the proper direction. Unfortunately, however, the check valves generally impose limitations on the type of material that may be pumped with diaphragm pumps. Another problem with many diaphragm pumps is that they may include relatively complex mechanical apparatus to move the diaphragms to produce the pumping action. Such mechanical apparatus may require periodic maintenance and may also be prone to failure.

Consequently, a need remains for a pump that can be used effectively with a wide range of materials, including "exotic" materials such as inhomogeneous sludges, cement slurries, paints, paint pigments, or pastes, including toothpastes, peanut butter, mashed potatoes, etc., as well as non-Newtonian fluids. Such a pump should also not subject the material being pumped to excessive shear stresses, therefore allowing the pump to be used with shear sensitive materials. Ideally, such a pump should include a minimum number of moving mechanical components, thereby minimizing maintenance and increasing reliability. Additional advantages could be realized if the flow rate and discharge pressure of such a pump could be independently controlled.

SUMMARY OF THE INVENTION

An electromagnetic peristaltic pump apparatus according to the present invention may comprise a main body section having an inlet end and an outlet end and a flexible membrane which divides the main body section into a first cavity and a second cavity. The first cavity is in fluid communication with the inlet end and the outlet end of the main body section. The second cavity is not in fluid communication with the first cavity and contains an electrically conductive fluid. A plurality of electrodes are positioned within the second cavity generally adjacent the flexible membrane. A magnetic field generator produces a magnetic field having a plurality of flux lines, at least some of which are contained within the second cavity of the main body section and are oriented generally parallel to a flow direction in which a material flows between the inlet end and the outlet end of the main body section. A control system selectively places a voltage potential across selected ones of the plurality of electrodes to deflect the flexible membrane in a wave-like manner to move material contained in the first cavity between the inlet and outlet ends of the main body section.

Also disclosed is a method for pumping material from an inlet end of a conduit to an outlet end of the conduit which comprises the steps of: providing the conduit with a flexible membrane that divides the conduit into a first cavity and a second cavity, the first cavity being in fluid communication with the inlet and outlet ends of the conduit, the second cavity being sealed from the first cavity and being filled with an electrically conductive fluid; providing a magnetic field having a plurality of flux lines at least some of which are contained within the second cavity and which are oriented in a direction generally parallel to a flow direction; and sequentially applying a voltage across selected pairs of a plurality of electrodes provided in the second cavity to cause the flexible membrane to be deflected into the first cavity in a wave-like manner from a region adjacent the inlet end to a region adjacent the outlet end, the wave-like deflection of the flexible member moving material in the first cavity from the inlet end to the outlet end.

BRIEF DESCRIPTION OF THE DRAWINGS

Illustrative and presently preferred embodiments of the invention are shown in the accompanying drawing in which.

DETAILED DESCRIPTION OF THE INVENTION

Figure 1:
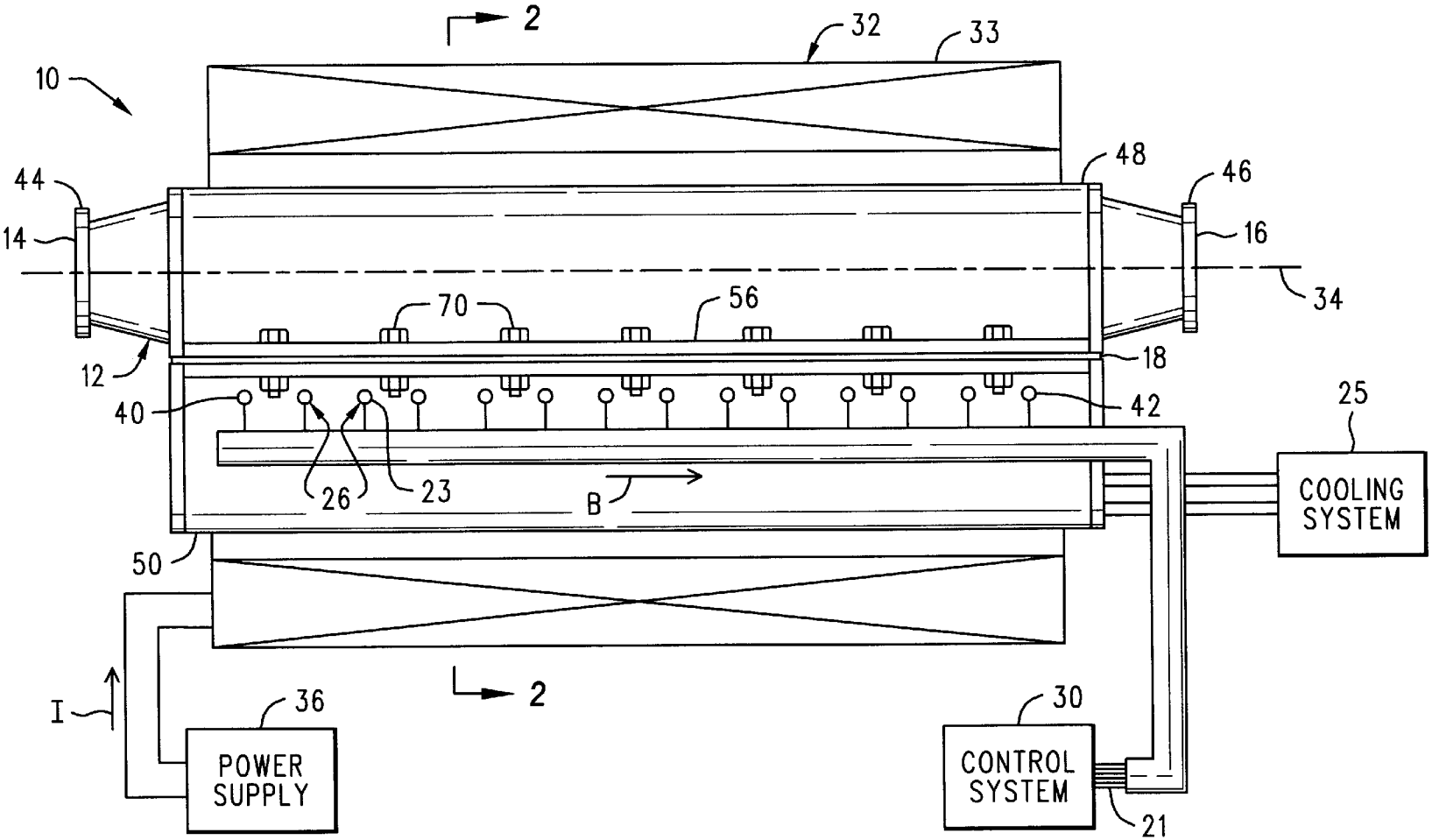
FIG. 1 is a side view in elevation of an electromagnetic peristaltic pump apparatus according to the present invention.
Figure 2:
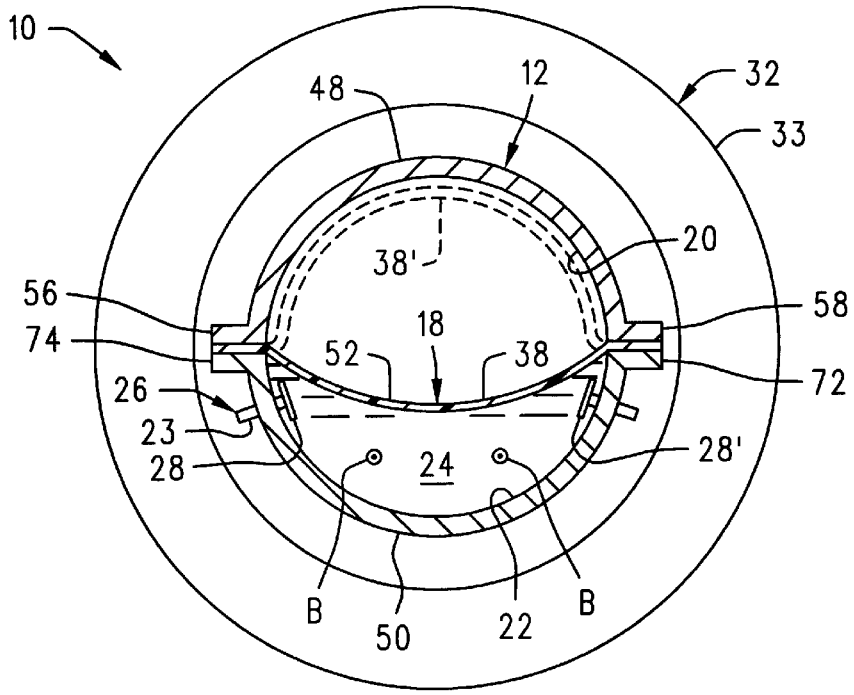
FIG. 2 is a cross-section view in elevation of the electromagnetic peristaltic pump apparatus taken along the line 2—2 of FIG. 1 with the flux lines of the magnetic field being substantially perpendicular to the plane of the paper.

An electromagnetic peristaltic pump 10 according to the present invention is best seen in FIGS. 1 and 2 and may comprise a main body section 12 having an inlet end member 14 and an outlet end member 16. The inlet and outlet end members 14 and 16 allow the pump 10 to be connected to a fluid handling or piping system (not shown). The material (not shown) to be pumped may be drawn into the pump 10 via the inlet end member 14 and may be discharged from the pump via the outlet end member 16. The main body section 12 includes a flexible membrane 18 which divides the main body section 12 into a first cavity 20 and a second cavity 22, as best seen in FIG. 2. The first cavity 20 is in fluid communication with the inlet and outlet end members 14 and 16 and may be referred to herein in the alternative as the "working cavity" or the "pumping cavity." The second cavity 22 is sealed from the first cavity 20 and may be referred to herein in the alternative as the "armature cavity." The second or armature cavity 22 is filled with an electrically conductive fluid 24 which may also be referred to herein as "armature fluid."

Figure 4:
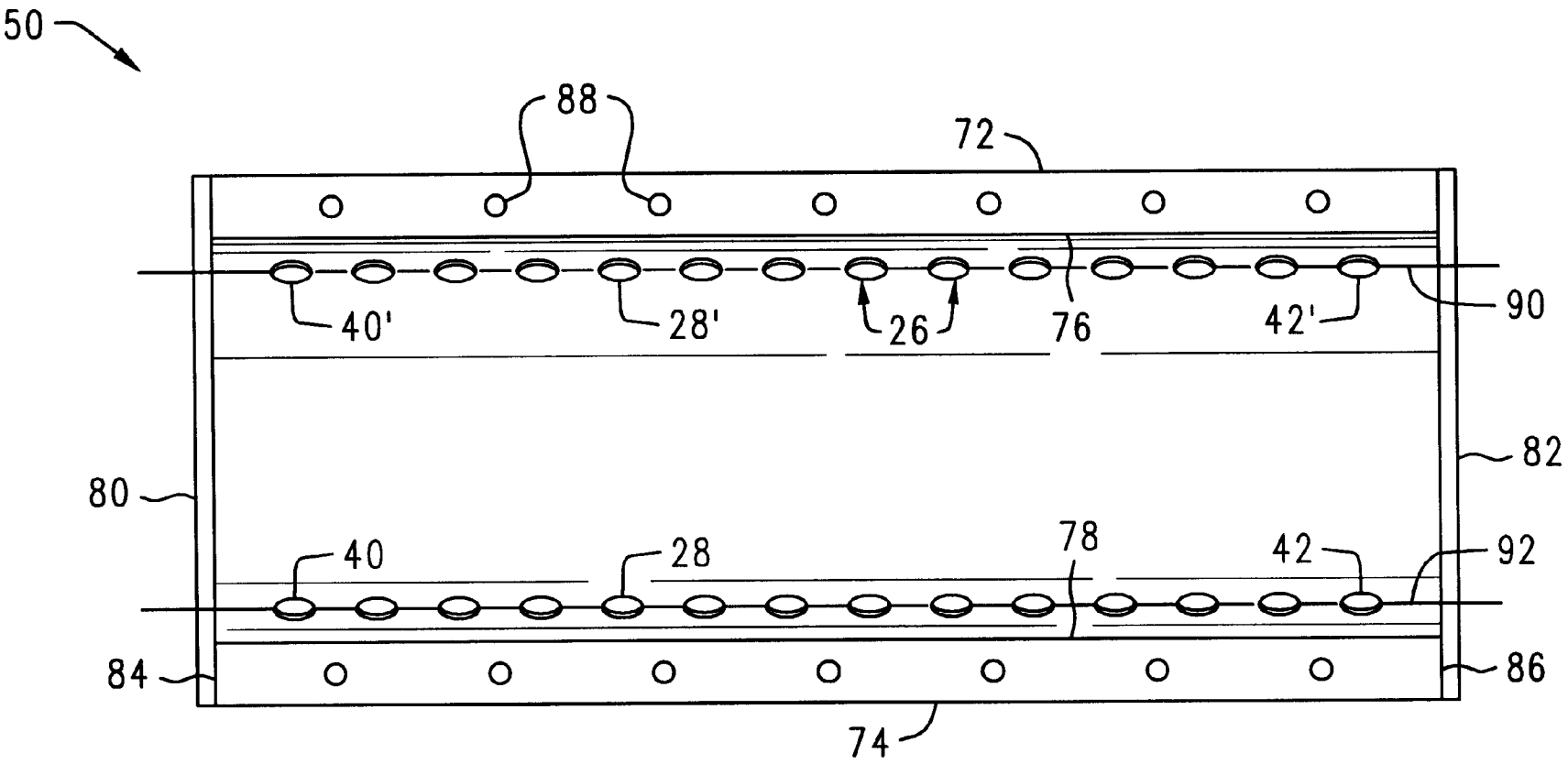
FIG. 4 is a plan view of the lower portion of the conduit member 12 showing the positioning of the various opposed electrode pairs.

The second cavity 22 of the main body section 12 is provided with a plurality of electrodes 26 that are arranged in a multiplicity of opposed electrode pairs e.g., 28, 28', as best seen in FIGS. 2 and 4. Each electrode 26 is electrically connected to a control system 30 (FIG. 1) which applies a voltage across selected opposed pairs (e.g., 28, 28') of electrodes 26, as will be described in greater detail below.

The electromagnetic peristaltic pump 10 is also provided with a magnetic field generator 32, such as a solenoid 33, which produces a magnetic field having a plurality of flux lines B, at least some of which are oriented so that they are generally parallel to the flow axis 34 connecting the inlet and outlet end members 14 and 16. The solenoid 33 may be connected to a power supply 36 which supplies a current I to the electromagnetic peristaltic pump 10 may be operated as follows to pump material (not shown) from the inlet end 14 to the outlet end 16. Assuming that the magnetic field generator 32 (e.g., solenoid 33) has been activated to create the magnetic field B, the control system 30 may initiate pumping by sequentially applying a voltage across opposed pairs (e.g., 28, 28') of the electrodes 26 contained within the second or armature cavity 22 of the main body section 12. Since the armature fluid 24 is electrically conductive, the voltage placed across a given opposed electrode pair causes a current (not shown) to flow through the armature fluid 24 between the opposed pair of electrodes 26. The current flowing through the armature fluid 24, combined with the magnetic field B, induces a Lorentz force in the armature fluid 24 which creates a localized pressure increase in the region of the energized electrode pair. The localized pressure increase causes the flexible membrane 18 to be deflected upward in the region of the energized electrode pair. Stated another way, the localized pressure increase in the armature fluid 24 caused by the Lorentz force moves the flexible membrane 18 from a relaxed position 38 to a deflected position 38', as best seen in FIG. 2.

The electromagnetic peristaltic pump 10 may be operated in a "forward" direction (i.e., to pump material from the inlet end member 14 to the outlet end member 16) by operating the control system 30 so that it sequentially applies the voltage potential between successive opposed pairs (e.g., 28, 28') of electrodes 26 beginning with the left-most opposed pair 40, 40' of electrodes 26 (located near the inlet end 14) and ending with the right-most opposed pair 42, 42' of electrodes 26 (located near the outlet end 16). See FIG. 4. The control system 30 then repeats the process. The localized pressure increase in the armature fluid 24 caused by the Lorentz force produced in the region of the energized electrode pair deflects upward the flexible membrane 18, resulting in a peristaltic or "wave" action to be produced in the flexible membrane 18 as the voltage potential is sequentially applied to successive opposed pairs of electrodes 26. The peristaltic or "wave" action of the flexible membrane 18 moves the material in the first or pumping chamber 20 from the region of the inlet end 14 to the outlet end 16.

The flexible membrane 18 may be deflected in any of a wide variety of ways to accomplish any of a wide variety of functions. For example, as stated above, the flexible membrane 18 may be used to pump material in the "forward" direction (i.e., from the inlet end 14 to the outlet end 16) by operating the control system 30 so that it sequentially energizes the opposed pairs of electrodes 26 beginning with the left-most opposed pair 40, 40' of electrodes 26 and ending with the right-most opposed pair 42, 42' of electrodes 26. Continuous pumping in the forward direction may be achieved by continuously repeating the foregoing sequence. Alternatively, material may be pumped in the "reverse" direction (i.e., from the outlet end 16 to the inlet end 14) by reversing the sequence. That is, the pump 10 may be operated in the reverse direction by operating the control system 30 so that it sequentially energizes the electrodes 26 beginning with the right-most opposed electrode pair 42, 42' and ending with the left-most opposed electrode pair 40, 40'. In still another application, the pump 10 may be operated as a valve to prevent the flow of material through the main body member 12 by energizing a given pair of opposed electrodes. The localized pressure caused by the Lorentz force displaces upward the flexible membrane 18 in the region of the energized electrode pair, thereby effectively pinching-off the flow of material within the working cavity 20 of pump 10.

As will be described in greater detail below, the rate at which the peristaltic "wave" is propagated determines the flow rate of the pump. The strength of the magnetic field and the current flowing through the armature fluid 24 determines the pressure produced in the region of the energized electrodes, thus the maximum discharge pressure of the pumped material.

A significant advantage of the peristaltic electromagnetic pump 10 according to the present invention is that it does not require rotating impellers, gears, or vanes, which allows the electromagnetic peristaltic pump to be used to pump a wide range of materials, such as liquids and slurries. The absence of rotating components (e.g., impellers, gears, or vanes) allows materials to be pumped which may contain relatively large solid particles and also dispenses with the need to provide bearings and seals, which can leak and may require periodic maintenance. Another advantage of the pump is that it does not subject the material being pumped to high shear stresses. Consequently, the pump is well-suited for pumping shear-sensitive fluids or other materials which may break down when subjected to high shear stresses. The pump 10 is also well-suited for pumping non-Newtonian fluids, i.e., fluids in which the shearing stress is not proportional to the rate of shearing deformation.

Yet another advantage of the electromagnetic peristaltic pump is that the pump may also be operated as a valve to stop the flow of material through the pump, thereby eliminating the need to provide a separate valve or other like apparatus to terminate the flow of material. The pump is also essentially free-flowing when de-energized, thereby making it ideal for initiating siphon flows.

Having briefly described the electromagnetic peristaltic pump 10 as well as some of its more significant features and advantages, the various preferred embodiments of the peristaltic pump according to the present invention will now be described in detail.

Referring back now to FIGS. 1 and 2, one embodiment 10 of an electromagnetic peristaltic pump according to the present invention may comprise a generally elongate, main body section 12 having an inlet end member 14 and an outlet end member 16. Alternatively, the main body section 12 may comprise other configurations. For example, the main body section 12 may be generally U-shaped, S-shaped, or nearly any shape that may be convenient or desirable for a given application. Consequently, the present invention should not be regarded as limited to pumps 10 having main body sections 12 that are substantially straight or linear as shown in FIG. 1. Regardless of the particular shape or configuration of the main body section 12 of the pump 10, the inlet end member 14 and outlet end member 16 may be provided with respective flanges 44 and 46 to allow the pump 10 to be connected to a fluid handling system (not shown). In one preferred embodiment, the flanges 44 and 46 may comprise flange couplings having standard ANSI (American National Standards Institute) configurations and specifications which will allow the pump 10 to be connected to a fluid handing system (not shown) comprising standard ANSI fittings. Alternatively, of course, the flanges 44 and 46 may be configured to conform to other standards or may even comprise custom fittings. In any event, since the electromagnetic peristaltic pump 10 according to the present invention may be used in any of a wide variety of fluid handing systems having any of a wide variety of sizes and configurations of fittings, the particular flanges 44 and 46 utilized on the inlet and outlet ends 14 and 16 will not be described in greater detail herein.

The main body section 12 may comprise a first or upper portion 48 and a second or lower portion 50 between which is located the flexible membrane 18. The arrangement is such that the flexible membrane 18 divides the main body section 12 into a first cavity 20 and a second cavity 22. See FIG. 2. The first cavity 20, which may also be referred to herein as the "working" or "pumping" cavity 20, is defined by the upper portion 48 of the main body section 12 and the working side 52 of the flexible membrane 18. Similarly, the second cavity 22, which may also be referred to herein as the "armature" cavity 22, is defined by the lower portion 50 of main body section 12 and ane 18.

In one preferred embodiment, the upper and lower portions 48 and 50 define a generally straight or linear main body section 12 having a substantially circular cross-section, as best seen in FIG. 2. Alternatively, other types of cross-sections (e.g., elliptical, square, rectangular, etc.,) are also possible, as would be obvious to persons having ordinary skill in the art. Consequently, the present invention should not be regarded as being limited to a main body portion 12 having the circular cross-section shown in FIG. 2.

Figure 3:
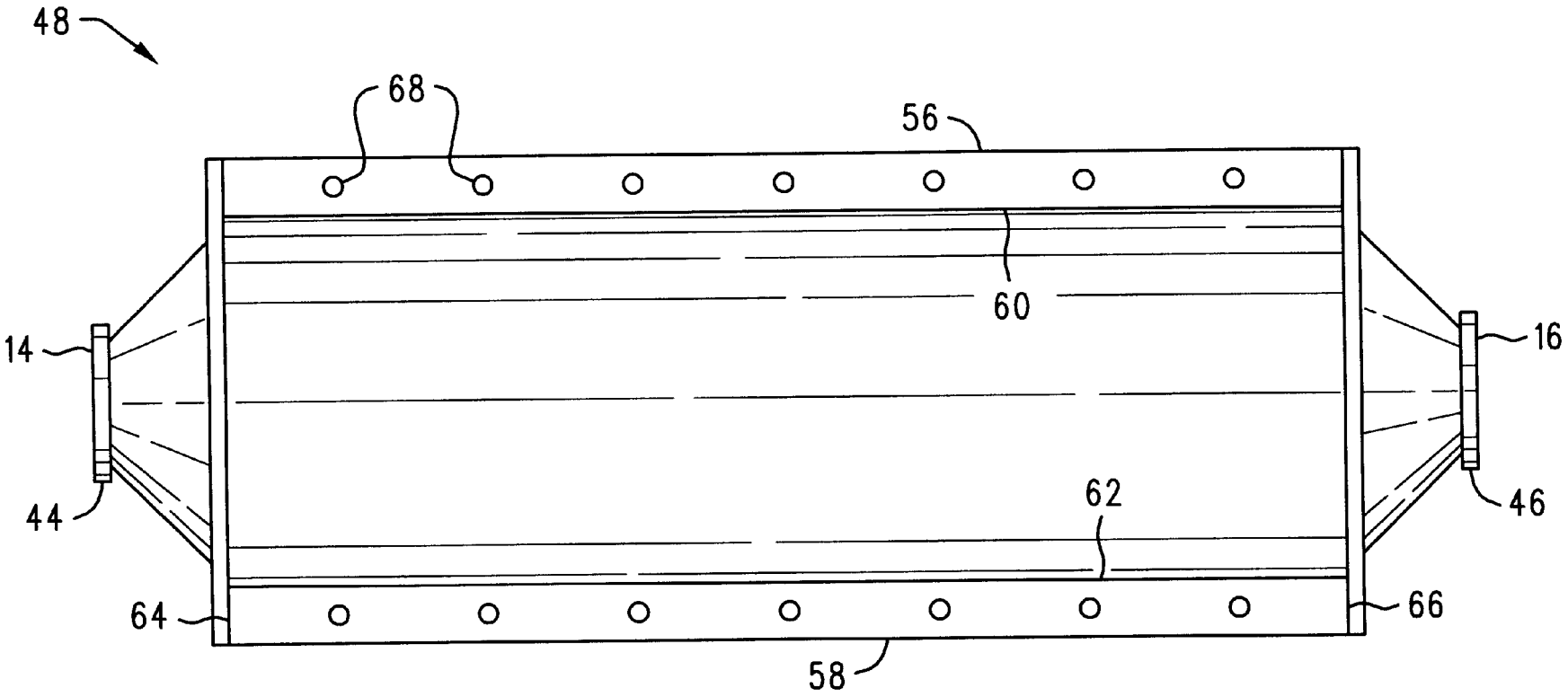
FIG. 3 is a plan view of the upper portion of the conduit member 12 showing the configuration of the inlet and outlet end members.

Referring now primarily to FIGS. 2 and 3, the upper portion 48 of main body section 12 may comprise a generally semi-cylindrical, tube-like member having a pair of lengthwise flanges 56 and 58 that extend along each side 60, 62 of the semi-cylindrical member. Each lengthwise flange 56, 58 may be provided with a plurality of holes 68 sized to receive a plurality of bolts or screws 70 (FIG. 1) which may be used to hold together the upper and lower portions 48 and 50 of the main body section 12. The inlet end member 14 may be attached to the inlet end 64 of the upper portion 48, whereas the outlet end member 16 may be attached to the outlet end 66 of the upper portion 48.

The upper portion 48 of main body section 12 may be made from any of a wide variety of materials (such as metals or plastics) suitable for the intended application. However, if the upper portion 48 is fabricated from a metal or metal alloy, then it is preferred that the metal or metal alloy be non-ferromagnetic so as to avoid shunting an excessive portion of the magnetic field B produced by the magnetic field generator 32, as will be described in greater detail below. As used herein, the term "ferromagnetic" refers to those metals, alloys, and compounds of the transition (iron group) rare-earth and actinide elements in which the internal magnetic moments spontaneously organize in a common direction, giving rise to a magnetic permeability considerably greater than that of vacuum and to magnetic hysteresis. Ferromagnetic materials may include, without limitation, iron, nickel, cobalt, and various alloys thereof. By way of example, in one preferred embodiment, the upper portion 48 is fabricated from a fiber-reinforced plastic material.

The lower member 50 is best seen in FIGS. 1, 2, and 4, and may also comprise a generally elongate, semi-cylindrical, tube-like member having a pair of lengthwise flanges 72 and 74 that extend along respective sides 76, 78 of the elongate, semi-cylindrical member. The lengthwise flanges 72, 74 may be provided with a plurality of holes 88 sized and spaced so that they are aligned with the holes 68 provided in the lengthwise flanges 56, 58 of the upper member 48 of the main body section 12. The lower member 50 may also be provided with a pair of end plates 80, 82 to close-off the ends 84, 86 of the elongate semi-cylindrical member.

The lower member 50 may also be provided with a plurality of electrodes 26 positioned near the flexible membrane 18, as best seen in FIG. 2. In one preferred embodiment, the electrodes 26 are arranged along two (2) rows 90, 92 adjacent the two sides 76, 78 of the lower member 50, as best seen in FIGS. 2 and 4. The arrangement is such that the electrodes 26 comprise a plurality of opposed electrode pairs (e.g., 28, 28'). In one preferred embodiment, each electrode 26 comprises a disk-shaped member, although other shapes or configurations may also be used. Each electrode 26 includes a terminal portion 23 that extends through the lower portion 50 of the main body member 12. The terminal portion 23 allows each electrode 26 to be electrically connected to the control system 30. See FIG. 1.

The various electrodes 26 may be made from any of a wide range of electrically conductive materials that would be suitable for the intended application. By way of example, in one preferred embodiment, each electrode 26 is made from copper, although other materials could also be used.

The lower portion 50 of the main body section 12 may be made from any of a wide range of materials, such as metals or plastics, suitable for the intended application. However, as was the case for the upper portion 48 of the main body section 12, it is preferred that the lower portion 50 of the main body section 12 be made from a non-ferromagnetic material to avoid shunting the magnetic field B produced by the magnetic field generator 32. By way of example, in one preferred embodiment, the lower portion of the main body section 12 may be fabricated from a fiber-reinforced plastic material.

Figure 5:
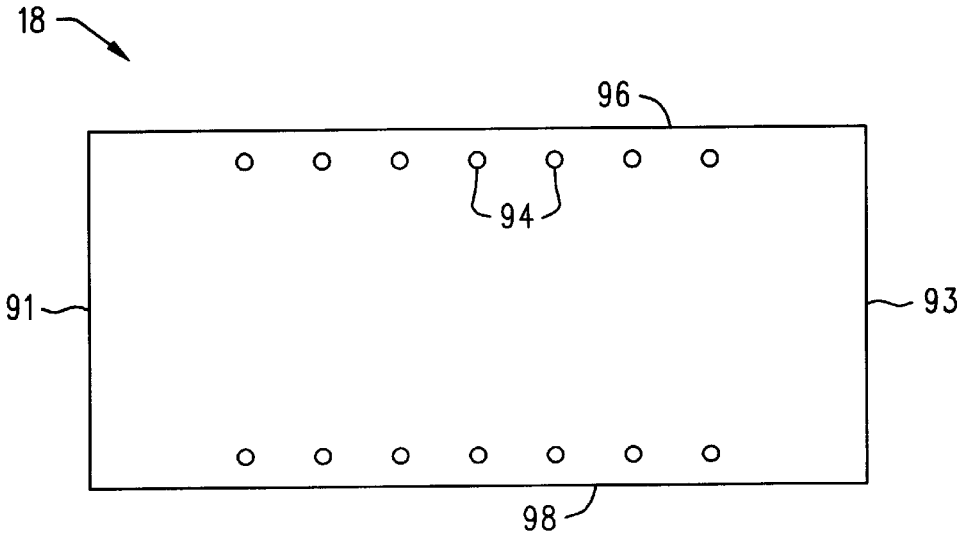
FIG. 5 is a plan view of the flexible membrane.

The flexible membrane 18 that separates the upper and lower portions 48 and 50 of the main body section 12 is best seen in FIG. 5. Essentially, the flexible membrane 18 may comprise a generally rectangular, sheet-like member adapted to be captured between the lengthwise flanges 56, 58, 72, and 74 of the respective upper and lower portions 48 and 50 of the main body section 12, as best seen in FIGS. 1 and 2. For example, in one preferred embodiment, the flexible membrane 18 may be provided with a plurality of holes 94 extending in lengthwise directions adjacent the two sides 96, 98 of the membrane. The holes 94 may be sized and spaced so that they are aligned with the holes 68 and 88 contained on the upper and lower portions 48 and 50 of the main body section 12. Accordingly, the plurality of bolts or screws 70 (FIG. 1) that may be used to connect the upper and lower portions 48 and 50 of the main body section 12 will also firmly secure the flexible member 18 between the upper and lower portions 48 and 50. The ends 91 and 93 of the membrane 18 may be captured between the end plates 80 and 82 on the lower portion 50 and the inlet and outlet end members 14 and 16 on the upper portion 48. In one preferred embodiment an adhesive (not shown), such as rubber cement, may be used to attach the ends 91, 93 of the membrane 18 to the members 80, 82 and 14, 16 of the lower and upper portions 50 and 48. Alternatively, the ends 91 and 93 of membrane 18 could also be provided with a plurality of holes (not shown) sized and spaced to correspond to holes (not shown) provided on transverse end flanges (also not shown) provided on the upper and lower portions 48 and 50 of main body section 12.

In an alternative embodiment, the flexible membrane 18 may be provided with contours, fluting, or other features, if desired, to provide the membrane with a shape that more closely matches the contour of the upper and lower portions 48 and 50 of the main body section 12. In addition, such contours, fluting, or other features may help to reduce stress concentrations in the flexible membrane 18. Consequently, the flexible membrane 18 utilized in one preferred embodiment of the present invention should not be regarded as being limited to the shapes and configurations shown and described herein.

The membrane 18 may comprise any of a wide range of elastomeric materials suitable for the intended application and the type of material to be pumped. Exemplary materials include nitrile rubber (Buna-N rubber), neoprene rubber, EPDM (ethylene propylene terpolymer), or Viton®, which is a federally registered trademark of DuPont Dow Elastomers, LLC of Wilmington, Del. In one preferred embodiment, the membrane 18 is fabricated from fabric-reinforced neoprene. The flexible membrane 18 may comprise any of a wide range of thicknesses depending on the particular application, the type of material to be pumped, the size of the pump, and other factors. Consequently, the present invention should not be regarded as being limited to flexible membranes having any particular thickness or range of thicknesses. By way of example, in one preferred embodiment, the flexible membrane 18 has a thickness of about 1.6 mm.

The armature cavity 22 defined by the armature side 54 of flexible membrane 18 and the lower portion 50 is filled with an electrically conductive armature fluid 24. In one preferred embodiment, the electrically conductive armature fluid 24 may comprise a slurry comprising a host liquid and an electrically conductive powder, although other electrically conductive liquids could also be used. The host liquid should be resistant to degradation by electrohydrolysis so that the fluid properties remain substantially constant and so that no hydrogen or corrosive gases are evolved during operation. Exemplary host liquids include oils, such as vegetable oil or linseed oil, although other compositions may be used. The electrically conductive powder may comprise any of a wide range of metal powders (e.g., aluminum, copper, bronze, etc.,) that are electrically conductive and non-reactive with the host liquid selected to suspend the powder. Alternatively, the electrically conductive powder may comprise a non-metallic, electrically conductive material, such as graphite powder. By way of example, in one preferred embodiment, the electrically conductive powder (e.g., metallic or nonmetallic) used to make the resulting slurry electrically conductive may comprise particles having sizes ranging from about 45 $\mu$m to about 60 $\mu$m and may comprise about 25% to 30% (by weight) of the armature fluid 24.

Each of the electrodes 26 is connected to an electrode control system 30 via a plurality of electrical conductors, such as wires 21. The control system 30 may be remotely located from the pump 10 and applies a voltage across opposed pairs (e.g., 28, 28') of electrodes 26 to produce a current flow through the armature fluid 24 in the region of the energized electrode pair. See FIG. 4. In one preferred embodiment, the control system 30 is capable of being operated so that it applies a voltage to any selected opposed electrode pair, e.g., 28, 28'. For example, if the pump 10 is to be operated in the forward direction, the control system 30 first applies a voltage across the left-most pair 40, 40' of electrodes 26 (FIG. 4). After a short time, the control system 30 removes the voltage from the left-most opposed electrode pair 40, 40' and applies a voltage to the opposed electrode pair immediately to the right of the left-most pair 40, 40'. The process may be repeated sequentially along the two rows 90, 92 of electrodes 26 until the rightmost pair 42, 42' is reached. The process may then be repeated beginning again with the left-most pair 40, 40'.

The voltage potential (and resulting current flow) that is to be applied across a given electrode pair (e.g., 28, 28') will depend on a variety of factors, including the overall size of the pump, the compliance of the flexible membrane 18, the electrical resistance of the armature fluid 24, and the strength of the magnetic field B produced by the magnetic field generator 32, just to name a few. The applied voltage may also depend on the desired pump discharge pressure. Consequently, the present invention should not be regarded as limited to any particular voltage potential.

The length of time that the voltage is applied to a given electrode pair is also dependant on a variety of factors, including the pump diameter and desired flow rate. Consequently, the present invention should not be regarded as limited to any particular time period. By way of example, in one preferred embodiment, the control system 30 applies the voltage to each opposed electrode pair for a time in the range of about 0.1 sec to about 1.0 sec.

The control system 30 may comprise any of a wide variety of systems known in the art for applying voltages and currents across terminal members or electrodes. However, since systems for periodically applying voltages and currents across electrodes are well-known in the art and could be easily provided by persons having ordinary skill in the art, and since the details of such systems are not necessary to understand the invention, the particular control system 30 utilized in one preferred embodiment of the present invention will not be described in further detail herein.

The electrical resistance of the armature fluid 24 may result in the gradual heating of the armature fluid 24 as the pump 10 is operated. Under most circumstances, the heat build-up in the armature fluid 24 may be transferred through the flexible membrane 18 and into the material being pumped. However, if the particular environment and application in which the pump 10 is to be used is such that the heat cannot be dissipated in this way, such as for example, if the pump is "dead-headed" (i.e., operated without the presence of the material to be pumped in the pumping cavity 20) or if the material being pumped is hot, then it may be necessary to provide the pump 10 with a cooling system 25 (FIG. 1) to remove heat from the armature fluid 24. The cooling system 25 may be connected to a heat exchanger (not shown) positioned within the armature cavity 22. A coolant (not shown) circulated through the heat exchanger may remove heat from the armature fluid 24, thereby preventing the armature fluid 24 from overheating. Alternatively, the heat exchanger (not shown) may be provided to the exterior of the lower portion 50. In still another embodiment, the lower portion 50 of the main body section 12 may be provided with cooling fins (not shown) to dissipate the heat.

As was briefly described above, the electromagnetic peristaltic pump 10 is also provided with a magnetic field generator 32 for producing a magnetic field having a plurality of flux lines B, at least some of which run generally parallel to the flow axis 34. See FIGS. 1 and 2. While any of wide variety of devices (e.g., electro-magnets or permanent magnets) may be used to produce the magnetic field B, in one preferred embodiment of the invention the magnetic field generator 32 comprises a solenoid 33 which produces an axial magnetic field having a plurality of flux lines B, a substantial portion of which run generally parallel to the flow axis 34 of the pump 10.

One advantage of the solenoid 33 is that it may readily conform to any of a wide range of shapes or configurations of the main body section 12. For example, if the main body section 12 comprises the substantially straight or linear configuration shown in FIG. 1, then the solenoid 33 may comprise a coil of wire wrapped around the main body section 12. Alternatively, if the main body section 12 comprises a U-shaped or S-shaped member, then the solenoid 33 may also comprise a coil of wire wrapped around the curved main body section 12. The magnetic field produced by such a curved solenoid will generally follow the curved flow axis associated with the curved main body section 12.

Regardless of the particular shape of the solenoid 33 (e.g., straight or curved), a power supply 36 may be used to provide a current I to the solenoid 33 required to produce the magnetic field. Alternatively, the magnetic field B may be produced by other means, such as by permanent magnets (not shown). The magnetic field B should be of sufficient strength to provide full deflection of the membrane 18 when a given voltage potential and current is applied across opposed pairs (e.g., 28, 28') of electrodes 26.

The power supply 36 for supplying the current I to the solenoid 33 may comprise any of a wide range of power supplies known in the art and that are readily commercially available for providing power to solenoids for the purpose of producing and maintaining a magnetic field. Consequently the particular power supply 36 utilized in one preferred embodiment will not be described in further detail herein.

The basic operating principle of the electromagnetic peristaltic pump 10 according to the present invention is as follows. Assuming that the magnetic field generator 32 (e.g., solenoid 33) has been activated to create the magnetic field B, the control system 30 may activate the pump by applying a voltage across an opposed pair (e.g., 28, 28') of electrodes 26 contained within the armature cavity 22 of the main body member 12. Since the armature fluid 24 is electrically conductive, the voltage placed across the opposed electrode pair will cause an electrical current (not shown) to flow through the armature fluid 24 generally in the region between the opposed electrode pair. The electrical current flowing through the armature fluid 24, combined with the transverse magnetic field B, induces a Lorentz force in the armature fluid 24 which results in a localized pressure increase in the region of the energized electrode pair. The localized pressure increase causes the flexible membrane 18 to be deflected upward in the region of the energized electrode pair. That is, the localized pressure increase in the armature fluid 24 caused by the Lorentz force moves the flexible membrane 18 from a relaxed position 38 to a deflected position 38', as best seen in FIG. 2.

In accordance with the foregoing basic operating principle, the electromagnetic peristaltic pump 10 may be operated according to any of a wide variety control "schedules" to accomplish various modes of operation. For example, the pump 10 may be operated in a "forward" mode, a "reverse" mode, a "free-flow" mode, and a "valve" mode, just to name a few. The foregoing operational modes will now be described in detail.

In the "forward" mode of operation the pump 10 draws material into the inlet end 14 and discharges it from the outlet end 16. In order to operate the pump 10 in the forward mode, the control system 30 is operated so that it applies the actuating voltage to opposed pairs of electrodes (e.g., 28, 28') in a sequential manner from left to right. For example, the control system 30 may first apply the voltage between the left-most opposed pairs of electrodes 40, 40', then to the pair immediately to the right and so on, until reaching the right-most opposed electrode pair 42, 42'. This process completes one pumping cycle. The pumping cycle may be repeated by re-applying the voltage to the left-most electrode pair 40, 40' and repeating the process. The discharge pressure of the pump 10 may be changed by varying the magnitude of the applied voltage (thus current) flowing through the electrodes 26. The discharge pressure may also be varied by changing the strength of the magnetic field B produced by the magnetic field generator 32. The flow rate of the pump 10 may be changed by varying the length of time that the voltage is applied to each opposed electrode pair, thereby changing the propagation speed of the peristaltic wave.

The pump 10 may also be operated in the "reverses" mode of operation to pump material from the outlet end member 16 to the inlet end member 14. Operation of the pump 10 in the reverse mode is essentially identical to operation in the forward mode, except that the control system 30 sequentially applies the voltage to the electrodes 26 generally in a direction from right to left. For example, the reverse mode may be initiated by operating the control system 30 to first apply the voltage across the right-most opposed electrode pair 42, 42', then to the electrode pair immediately to the left and so on, until reaching the leftmost opposed electrode pair 40, 40'. The foregoing process may then be repeated as necessary to continue pumping in the reverse direction.

In the "free-flow" mode of operation, the pump 10 is essentially idle (i.e., not energized) which allows the material being pumped to flow in either the forward or reverse directions. This mode of operation is particularly suitable for siphon flows. For example, a siphon flow may be initiated by operating the pump 10 in either the forward or reverse modes, as the case may be, to initiate the flow of material. Thereafter, the pump 10 may be de-energized, in which case the material will continue to flow though the main body section 12 of the pump 10 due to siphon action.

The pump 10 may also be operated in the "valve" mode to either restrict or stop the flow of material through the main body portion 12 of pump 10. In this mode, the control system 30 is operated to apply a voltage potential across an opposed electrode pair, preferably located near the mid-section of the pump 10. Application of the maximum voltage potential (thus current) will cause the flexible membrane 18 to fully deflect, thereby completely closing-off the working cavity 20 of the pump 10. Alternatively, smaller voltages (and resulting currents) may be applied which only partially deflect the flexible membrane 18, thereby partially closing-off the working cavity 20 and limiting the flow rate through the pump 10.

Other control schedules are also possible. For example, while the foregoing operational modes may be accomplished by energizing opposed electrode pairs one at a time, two or more adjacent electrodes pairs may be energized simultaneously. The electrodes may also be energized in such a way that two or more peristaltic waves are produced in the flexible member 18. Accordingly, the present invention should not be regarded as limited to the particular electrode energizing sequences described herein or the particular control schedules described herein.

Figure 6:
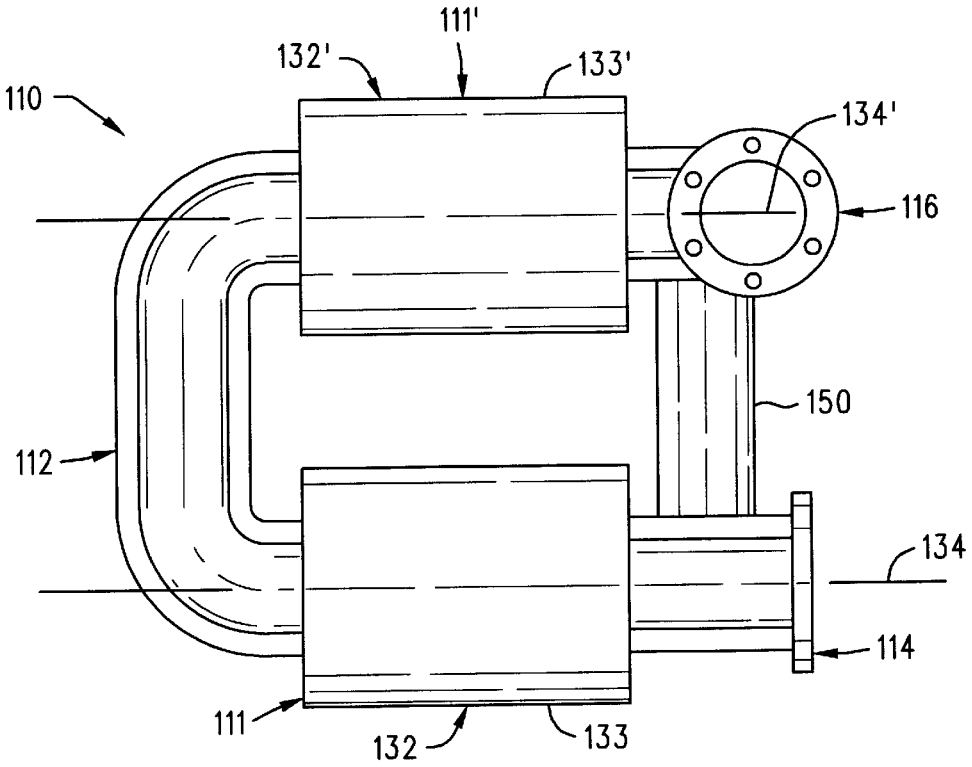
FIG. 6 is a plan view of a second embodiment of the electromagnetic peristaltic pump according to the present invention.
Figure 7:
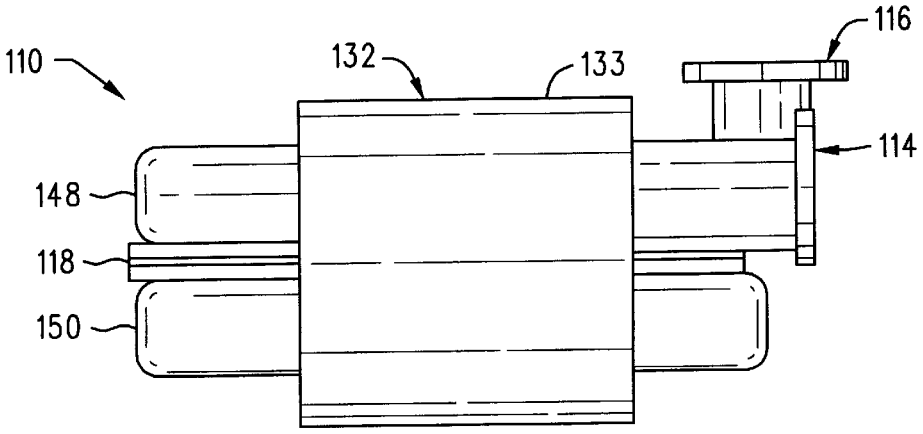
FIG. 7 is a side view in elevation of the electromagnetic peristaltic pump apparatus shown in FIG. 6.

As was briefly mentioned above, electromagnetic peristaltic pumps according to the present invention may take on a wide variety of shapes and configurations depending on the particular application. For example, a second embodiment 110 of an electromagnetic peristaltic pump according to the present invention is shown in FIGS. 6 and 7 and may comprise a main body section 112 in the shape of a generally oblate toroid and having two pumping sections: A primary pumping section 111 and a secondary pumping section 111'. As was the case for the first embodiment 10, the main body section 112 of the second embodiment 110 may comprise an upper portion 148 and a lower portion 150 separated by a flexible membrane 118. The upper portion 148 of main body section 112 may comprise a generally U-shaped member having an inlet end member 114 and an outlet end member 116. The lower portion 150 of the main body section 112 may comprise a generally O-shaped or toroidally shaped member that forms a continuous, endless loop. The flexible member 118 which divides the main body section 112 into the pumping cavity and armature cavity may comprise a generally U-shaped member sized to be captured between the upper and lower portions 148 and 150, in a manner similar to that already described for the first embodiment 10. Accordingly, while the armature fluid (not shown) is entirely contained within the lower portion 150, it may be free to circulate throughout the toroidally shaped lower portion 150, thereby providing for the possibility of increased cooling of the armature fluid, either through natural convection or via a supplemental cooling system (not shown).

The primary pumping section 111 of the main body section 112 includes a primary magnetic field generator 132, such as a primary solenoid 133. The primary solenoid 133 produces a magnetic field that is generally parallel to the flow axis 134 in the corresponding portion of the main body section 112. The lower portion 150 of the main body section 112 is provided with a plurality of electrodes (not shown) which, in combination with the magnetic field produced by the primary solenoid 133, causes the flexible membrane 118 to deflect in the manner already described for the first embodiment 10.

The secondary pumping section 111' is essentially identical to the primary pumping section 111 and includes a secondary magnetic field generator 132', such as a secondary solenoid 133'. The secondary solenoid 133' produces a magnetic field that is generally parallel to the flow axis 134' in the corresponding portion of the main body section 112. The lower portion 150 of main body section 112 is also provided with a plurality of electrodes (not shown) in the region of the secondary solenoid 133. The electrodes (not shown) may be energized by a control system (not shown) to deflect the flexible membrane 118 in the region of the secondary pumping section 111' in the manner already described.

The primary and secondary pumping sections 111 and 111' provide the second embodiment 110 of the electromagnetic peristaltic pump with increased capacity, generally providing that the inventive concepts herein described may be variously otherwise embodied and it is intended that the appended claims be construed to include alternative embodiments of the invention except insofar as limited by the prior art.

I claim:

1. Pump apparatus, comprising:

a main body section having an inlet end and an outlet end;

a flexible membrane operatively associated with said main body section which divides said main body section into a first cavity and a second cavity, the first cavity being in fluid communication with the inlet end and the outlet end of said main body section, the second cavity not being in fluid communication with the first cavity, the second cavity containing an electrically conductive fluid;

a magnetic field generator operatively associated with said main body section for producing a magnetic field having a plurality of flux lines, at least some of which are contained within the second cavity and are oriented generally parallel to a flow direction in which a material flows from the inlet end to the outlet end of said main body section;

a plurality of electrodes contained within the second cavity of said main body section; and a control system for selectively placing a voltage potential across selected ones of said plurality of electrodes.

2. The pump apparatus of claim 1, wherein said magnetic field generator comprises a solenoid surrounding said main body section and a power supply for providing a current to said solenoid to produce the magnetic field.

3. The pump apparatus of claim 2, wherein the electrically conductive fluid contained within the second cavity of said main body section comprises a host liquid fraction and a solid powder fraction.

4. The pump apparatus of claim 3, wherein said host liquid fraction comprises an oil composition.

5. The pump apparatus of claim 3, wherein said solid powder fraction comprises at least one particulate metallic composition.

6. The pump apparatus of claim 3, wherein said solid powder fraction comprises at least one particulate non-metallic composition.

7. The pump apparatus of claim 6, wherein said non-metallic composition comprises graphite.

8. The pump apparatus of claim 3, wherein said plurality of electrodes comprise a multiplicity of electrode pairs positioned in substantially opposed, spaced-apart relation on opposite sides of the second cavity and extending from a position near the inlet end of said main body section to a position near the outlet end of said main body section.

9. The pump apparatus of claim 8, wherein said main body section comprises a generally elongate cylindrical member.

10. The pump apparatus of claim 9, wherein the inlet end and the outlet end of said main body section are adapted to conform to ANSI standard dimensions for pipe conduits.

11. The pump apparatus of claim 10, further comprising a cooling system operatively associated with said main body section for removing heat from the electrically conductive fluid contained within the second cavity of said main body section.

12. The pump apparatus of claim 1, wherein said main body section comprises:

a first generally concave section having a first flange member and a second flange member; and a second generally concave section having a first flange member and a second flange member, the first and second flange members of said first generally concave section being adapted to be attached to the first and second flange members of said second generally concave section so that said flexible membrane is retained therebetween, said first generally concave section and a first side of said flexible membrane defining the first cavity and said second generally concave section and a second side of said flexible membrane defining the second cavity.

13. The pump apparatus of claim 12, wherein said first and second generally concave members each comprise an elongate member having a generally semi-circular cross-section so said main body comprising said first and second generally concave members comprises a generally cylindrically shaped member.

14. Pump apparatus, comprising:

a first elongate, generally semi-cylindrical portion having an inlet end and an outlet end;

a second elongate, generally semi-cylindrical portion adapted to be attached to said first elongate, generally semi-cylindrical portion to form an elongate, generally cylindrical main body section;

a flexible membrane positioned between said first and second elongate, generally semi-cylindrical portions, said flexible membrane dividing the elongate, generally cylindrical main body section into a first cavity and a second cavity, the first cavity being in fluid communication with the inlet and outlet ends of said first elongate, generally semi-cylindrical portion, the second cavity being fluidically isolated from the first cavity, the second cavity containing an electrically conductive fluid;

a plurality of electrodes contained within the second cavity of the elongate, generally cylindrical main body section;

a magnetic field generator operatively associated with the pump for producing a magnetic field having a plurality of flux lines, at least some of which are contained within the second cavity and are oriented generally parallel to a flow direction in which a material flows between the inlet and outlet ends of said first elongate, generally semi-cylindrical portion; and a control system for selectively placing a voltage potential across selected ones of said plurality of electrodes.

15. The pump apparatus of claim 14, wherein said magnetic field generator comprises a solenoid surrounding the elongate, generally cylindrical main body section and a power supply for providing a current to said solenoid to produce the magnetic field.

16. The pump apparatus of claim 15, wherein the electrically conductive fluid contained within the second cavity of said elongate, generally cylindrical main body section comprises a host liquid fraction and a solid powder fraction.

17. The pump apparatus of claim 16, wherein said plurality of electrodes comprise a multiplicity of electrode pairs positioned in substantially opposed, spaced-apart relation on opposite sides of the second cavity and extending from a position near the inlet end of the elongate, generally cylindrical main body section to a position near the outlet end of the elongate, generally cylindrical main body section.

18. The pump apparatus of claim 17, wherein said flexible membrane comprises neoprene.

19. A method for pumping a material from an inlet end of a conduit to an outlet end of the conduit, comprising the steps of:

providing the conduit with a flexible membrane that divides the conduit into a first cavity and a second cavity, the first cavity being in fluid communication with the inlet and outlet ends of the conduit, the second cavity being sealed from the first cavity and being filled with an electrically conductive fluid;

providing a magnetic field having a plurality of flux lines at least some of which are contained within the second cavity and which are oriented in a direction generally parallel to a flow direction; and sequentially applying a voltage across selected ones of a plurality of electrodes provided in the second cavity to cause the flexible membrane to be deflected into the first cavity in a wave-like manner from a region adjacent the inlet end to a region adjacent the outlet end, the wave-like deflection of the flexible member moving material in the first cavity from the inlet end to the outlet end.

20. The method of claim 19, wherein the step of sequentially applying a voltage across selected ones of the plurality of electrodes causes the flexible membrane to be deflected into the first cavity in a wave-like manner from a region adjacent the outlet end to a region adjacent the inlet end, the wave-like deflection of the flexible member moving material in the first cavity from the outlet end to the inlet end.

21. The method of claim 19, wherein the step of sequentially applying a voltage across selected ones of the plurality of electrodes comprises the step of applying a voltage across a selected pair of said plurality of electrodes to cause the flexible membrane to be deflected into the first cavity to block the flow of material between the inlet end and the outlet end.

22. Pump apparatus, comprising:

a U-shaped main body section having an inlet end and an outlet end;

a flexible membrane mounted within said U-shaped main body section which divides said U-shaped main body section into a first cavity and a second cavity, the first cavity being in fluid communication with the inlet end and the outlet end of said U-shaped main body section, the second cavity not being in fluid communication with the first cavity, said second cavity containing an electrically conductive fluid;

a magnetic field generator operatively associated with said pump for producing a magnetic field having a plurality of flux lines, at least some of which are contained within the second cavity and which are oriented in a direction that is generally parallel to a flow direction in which a material flows from the inlet end to the outlet end;

a plurality of electrodes contained within the second cavity of said U-shaped main body section in the region of the magnetic field; and a control system for selectively placing a voltage potential across selected ones of said plurality of electrodes.

* * * * *